United States Patent [19]

Hawkins

[11] Patent Number: 4,730,103

[45] Date of Patent: Mar. 8, 1988

[54] COMPACT PTC RESISTANCE HEATER

[75] Inventor: Donald R. Hawkins, Cornish, Me.

[73] Assignee: GTE Products Corporation, Stamford, Conn.

[21] Appl. No.: 935,884

[22] Filed: Nov. 28, 1986

[51] Int. Cl.[4] ..... H05B 3/08

[52] U.S. Cl. ..... 219/541; 219/505; 338/22 R

[58] Field of Search ..... 219/505, 504, 540, 541, 219/544; 338/22 R

[56] References Cited

U.S. PATENT DOCUMENTS

| | | | |
|---|---|---|---|
| 4,086,467 | 4/1978 | Grant | 219/505 |
| 4,104,509 | 8/1978 | Bokestal et al. | 219/544 |
| 4,518,850 | 5/1985 | Grasso | 219/505 |
| 4,580,034 | 4/1986 | Roth | 219/506 |

*Primary Examiner*—Harold Broome
*Attorney, Agent, or Firm*—James Theodosopoulos

[57] ABSTRACT

A compact resistor heater device is disclosed comprising a resistor body of ceramic material having a positive temperature coefficient of resistance and having electrically conductive elements disposed upon the resistor body for conducting current from one side of a power supply to one side of the resistor body. The resistor device is encapsulated with a coating of thermally conductive material. In an alternate embodiment of the resistor heater device, a thermally conductive member is disposed in thermally conductive relationship to said resistor body and serves as a heat sink to dissipate the heat generated by the resistor body substantially uniformly over a greater area.

4 Claims, 5 Drawing Figures

COMPACT PTC RESISTANCE HEATER

FIELD OF THE INVENTION

The present invention relates to self-regulating heaters and, more particularly, to an improved compact positive-temperature-coefficient (PTC) heater and the method of forming the same.

BACKGROUND OF THE INVENTION

Resistors formed of ceramic materials of positive temperature coefficient of resistivity (PTC) are used in many applications as current limiting devices and as self-regulating heaters. When electrical current is directed through such materials, the materials tend to heat and display increasing resistivity so that current flow in the resistor is reduced whereby its rate of heat generation is decreased. When the rate of heat generation reaches equilibrium with the rate of heat dissipation from the resistor, the resistor temperature stabilizes and limits the resistor current to a predetermined level. The initial room temperature resistivity of a PTC material and the rate of change of resistivity with temperature are characteristic of the material, and the materials used in such resistors are commonly chosen to display a sharp anomalous increase in resistivity at a particular temperature, thereby to stabilize heating of the resistor at about that temperature while also reducing resistor current to a very low level at the stabilizing temperature.

PTC heaters have been in used for many years. Such heater offer several operating advantages over conventional resistance heating elements in the heating of fuels. They can be made in a flat shape and are formed, generally, of doped barium titinate ceramics which have a sharp positive temperature coefficient of resistance. The PTC heaters are designed such that below a critical temperature, the resistance of the ceramic remains at a low value and is essentially constant. When a particular temperature is reached, a crystalline phase change takes place in the ceramic and this change in crystal structure is accompanied by a sharp increase in the resistance at the crystalline grain boundaries. The result of this crystalline change is an increase in the heater resistance of several orders of magnitude over a very small temperature range. A barium titinate heater with a room temperature resistance of 3.0 ohms will increase to 1,000 ohms or more during the crystalline phase change. The temperature at which the crystalline phase change takes place can be adjusted in the PTC manufacturing process through the use of appropriate chemical dopents and can be varied between −50° C. and 300° C. When energized with a suitable voltage by applying current to the opposite sides of the PTC heater, the ceramic rapidly heats up to a predetermined operating temperature and then "locks in" at this temperature. This rapid heating is due to the initial low resistance of the PTC ceramic heater which results in an internal high power of the heater. The "lock in" is due to the abrupt increase in resistance which causes generated power to be reduced until it equals dissipated power. At this point, thermal equilibrium is achieved and the PTC heater self-regulates itself at that temperature.

In prior art devices where PTC resistors are used particularly as self-regulating heaters, various designs and assemblies have been employed in an effort to satisfy new applications when such PTC heaters could be employed. The requirements of such applications include maximizing heat transfer, maintaining the integrity of the PTC resistor from environmental effects, maintaining a substantially uniform distribution of heat to the medium to be heated, and delivering higher temperatures without degradation of the PTC heater. Equally important is that the PTC heater be a device having a structure which is rugged, compact, reliable and inexpensive and simple to form.

Examples of such prior art PTC resistors employed as heaters are disclosed in the following patents: U.S. Pat. No. 4,242,999 to Hoser which discloses heaters in the shape of a "pill"; U.S. Pat. No. 4,406,785 to Seiter which discloses a plurality of pill-like PTC heaters disposed in a ring-array; and U.S. Pat. No. 4,107,515 to Kulwicki which discloses a compact resistor device having a large number of passageways extending between opposite ends of the body.

While the foregoing prior art patents have provided improvements in the areas for which they were intended, there still exists a need to provide a compact PTC resistor which meets the application requirements disclosed above.

Accordingly, an object of the present invention is to provide a compact PTC resistor device which is particularly suitable or useful as a self-regulating heater that will maximize heat transfer while maintaining the integrity of the heater from environmental effects.

Another object of the present invention is to provide a compact PTC resistor device of the above desirable object which produces a substantially uniform distribution of heat to the medium to be heated while delivering higher temperature transfer without degradation of the device.

SUMMARY OF THE INVENTION

The compact resistor device of the present invention comprises a resistor body preferably formed of a ceramic material having a positive temperature coefficient of resistivity. The body is provided with electrically conductive elements disposed upon the resistor body for conducting current from a power supply to the two sides of the resistor body. A thermally conductive member is disposed in thermal conductive relationship to the resistor body. The so assembled resistor body is encapsulated with a layer of substantially inert, thermally conductive plastic material to form the completed compact PTC resistance heating device. The thermally conductive member serves as a heat sink to dissipate the heat generated by the resistor body substantially uniformly over a greater area. The encapsulating process is preferably carried out by a transfer or insert molding process to provide a substantially uniform coating layer that is substantially free of voids or air pockets which can have an adverse effect on resistor body performance. The encapsulating material is preferably a thermoplastic which is thermally conductive and has a break-down temperature in excess of the particular operating temperature of the resistor body. In alternate embodiments of the invention, electrically conductive prongs serve as the conductive elements connecting the resistor device to a source of current. Additionally, in another embodiment, a light is electrically connected to the resistor body so as to be responsive to current flow through the resistor body at the particular operating temperature of the body to indicate that the heater is operating.

DETAILED DESCRIPTION OF THE PREFERRED EMBODIMENTS

Figure 1:
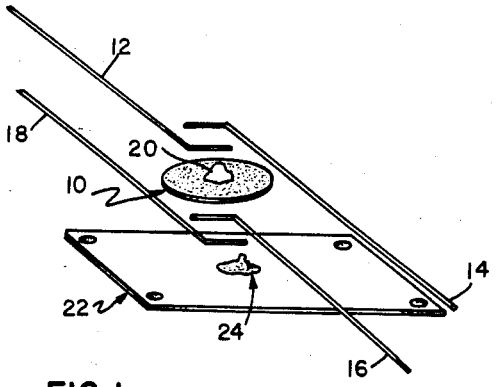
FIG. 1 is an explode perspective view of an unencapsulated compact resistor device in accordance with the present invention.
Figure 2:
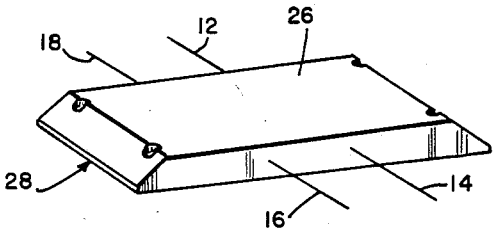
FIG. 2 is a perspective view of the compact resistor device of FIG. 1 in encapsulated form.

Referring now to FIGS. 1 and 2 of the drawing, there is illustrated one embodiment of the novel and improved resistor device of the present invention which is shown to include a resistor body 10 formed of a material having a positive temperature coefficient of resistivity. Preferably, the resistor body is formed of a conventional ceramic resistor material such as lanthanum doped barium titinate or the like and preferably the resistor material is selected to display a sharp anomolous increase in resistivity when the resistor body is heated to a particular temperature. Electrical lead-in wires 12, 14, 16 and 18 are bonded to each side of resistor 10 and serve as terminals for connection to a power source and associated circuitry (not shown). The lead-in wires are preferably bonded to the resistor body 10 by soldering, using a suitable solder paste 20 well known to those skilled in the art. The resistor 10 and lead-in wires are disposed upon a heat sink 22 which serves to dissipate the heat generated by the PTC resistor heater body 12 over a substantially uniformly greater are. The heat sink 22 can be suitably formed of metals or alloys such as copper or steel which are thermally conductive. The metallic heat sink 22 and resistor body 10 are preferably bonded together by soldering with a suitable solder paste 24 as is well known in the art.

The PTC heater resistor body 10, assembled with lead-in wires and heat sink, is then encapsulated with a suitable material 26 to provide the compact PTC heater of the present invention shown generally at 28. One suitable encapsulating material is a thermoplastic made by Philips Corporation and sold under the trade name Ryton. The main requirements of the encapsulating material is that it be electrically non-conductive, thermally conductive, substantially chemically inert and have a breakdown or degradation temperature in excess of between about 250° to 270° C. Ryton thermoplastic has the following characteristics:

UL94VO—dielectric strength 400 volts/mil, water absorption $<0.05\%$, and thermal conductivity BTU. in./h.ft.$^2$ °F. $=4.0$.

It has been discovered that the encapsulating process is preferably carried out by transfer or insert molding techniques wherein the assembled PTC resistor is placed in a plastic molding machine and encapsulated with a suitable thermoplastic material such as the Ryton thermoplastic. As briefly stated, in the transfer molding process, the thermoplastic is plasticized by heating and then conducted in a rapidly flowing condition to a closed mold chamber containing the assembled PTC resistor assembly. The plasticized material is flowed into the closed mold, whereby the mold is filled without violent surges of the plastic as occurs at high pressures. Pressure is then applied to the plastic in the mold while heating sets the formed plastic material. The finished compact PTC resistor heater is then removed from the mold in the form illustrated in FIG. 2, for example. It has been discovered that encapsulating the PTC resistor assemblies in this manner eliminates voids or air spaces which have an adverse effect on heat transfer since the spaces tend to act as insulators. Additionally, oxygen trapped in such voids tends to degrade the plastic at high temperatures.

It is to be understood that while the heat sink 22 has been illustrated as having a generally rectangular configuration, other shapes can be employed such as circular, elliptical, etc. depending upon the particular application. Similarly, the size of the heat sink 22 can be varied depending upon the desired application or a plurality of PTC heaters can be ganged on a single heat sink to form an elongated heater. The resistor bodies can typically be formed of a conventional lanthanum - doped barium titanate having an empirical formula of $BaPbLaTiO_3$. Such a resistor material has a room temperature resistivity of about 36 ohm-centimeters and a Curie temperature resistivity of about 140° C. and will display a sharp, anomalous increase in resistivity to about 10 ohm-centimeters when the resistor is heated to above its anomaly temperature of 200° C.

Figure 3:
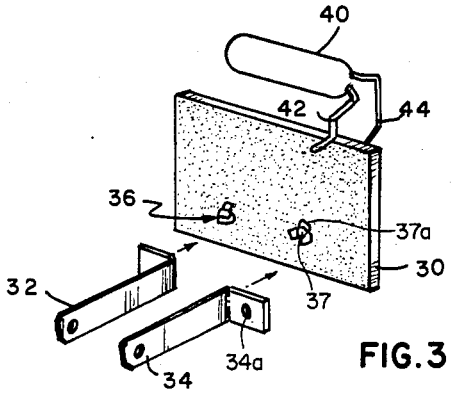
FIG. 3 is an exploded perspective view of the alternate embodiment of a compact resistor device illustrating the components in unencapsulated form.
Figure 4:
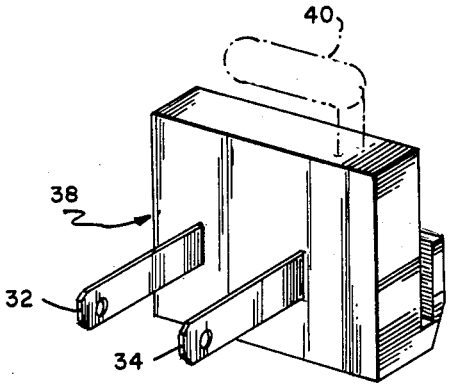
FIG. 4 is a perspective view of the compact resistor device of FIG. 3 in encapsulated form.
Figure 5:
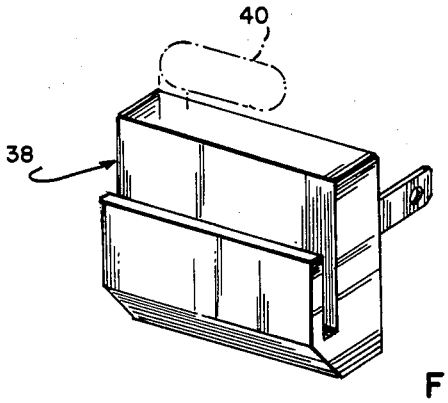
FIG. 5 is a perspective view of the reverse side of the compact resistor device of FIG. 4.

Referring now to FIGS. 3 to 5, an alternate embodiment of the invention is illustrated particularly adapted for plug-in applications. As shown, the resistor body 30 is formed in a rectangular shape. A pair of electrical prongs or blades 32 and 34 are bonded to the resistor body 30 preferably by soldering using a suitable solder paste 36 as described hereinbefore. Prong 34 is attached to the resistor body 30 by means of a fastener (not shown) such as a rivet disposed in hole 34*a* and extending into the resistor body 30 through the hole 37. Insulator 37*a* prevents electrical contact between the face side (shown) of body 30 and the prong 34. The fastener is attached to the obverse side (not shown) of the resistor body 30. The assembled resistor body and prongs are then encapsulated in a thermoplastic as described with respect to FIGS. 1 and 2 to provide the compact PTC heater 38 shown in FIG. 4.

In a still further embodiment of the invention, referring still to FIGS. 3 to 5, a lamp 40 is attached by lead-in wires 42 and 44 to either side of the resistor body 30. A suitable lamp would be a small neon lamp of low power requirements. In this arrangement, upon plug-in of the PTC resistor heater, the lamp 40, shown by dotted lines in FIGS. 4 and 5 would glow brightly until the anomalous increase in resistivity occurs at a particular temperature resulting in a reduction of the resistor current to a very low level at which point the lamp would turn-off or reduce in intensity depending upon the power requirements selected. In this arrangement, the operational mode of the PTC resistor heater can be easily determined.

It is apparent that modifications and changes can be made within the spirit and scope of the present invention. It is my intention, however, only to be limited by the appended claims.

In my invention, I claim:

1. A compact resistor heater device having a particular operating temperature comprising:

a resistor body of ceramic material having a positive temperature coefficient of resistance;

electrically conductive means disposed upon said resistor body for conducting current from opposite sides of a power supply to opposite sides of said resistor body;

a thermally conductive member formed of a sheet of metal disposed in thermally conductive relationship to said resistor body; and a coating of thermally conductive material substantially free of voids entirely covering said resistor body and thermally conductive member.

2. The compact resistor heater device of claim 1 wherein the resistor body is formed of a ceramic titinate material.

3. The compact resistor heater device of claim 1 wherein said thermally conductive coating has a breakdown temperature in excess of said operating temperature.

4. The compact resistor heater device of claim 1 further comprising light means electrically connected to said resistor body and responsive to current flow through said resistor body at said particular operating temperature.

* * * * *